US007279440B2

(12) United States Patent
Berrigan et al.

(10) Patent No.: US 7,279,440 B2
(45) Date of Patent: Oct. 9, 2007

(54) NONWOVEN AMORPHOUS FIBROUS WEBS AND METHODS FOR MAKING THEM

(75) Inventors: Michael R. Berrigan, Oakdale, MN (US); Anne N. De Rovere, Woodbury, MN (US); William T. Fay, Woodbury, MN (US); Jerald W. Hall, Jr., Maplewood, MN (US); Pamela A. Percha, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 57 days.

(21) Appl. No.: 10/151,780

(22) Filed: May 20, 2002

(65) Prior Publication Data

US 2003/0216099 A1 Nov. 20, 2003

(51) Int. Cl.
*D04H 1/00* (2006.01)
*D04H 1/54* (2006.01)

(52) U.S. Cl. ..... 442/409; 442/417; 442/334; 442/333; 442/350

(58) Field of Classification Search ..... 442/409, 442/411, 334, 417, 333, 350
See application file for complete search history.

(56) References Cited

U.S. PATENT DOCUMENTS

| | | | |
|---|---|---|---|
| 3,322,607 | A | 5/1967 | Jung |
| 3,734,803 | A | 5/1973 | Lipscomb et al. |
| 3,766,606 | A | 10/1973 | Piper et al. |
| 3,783,649 | A | 1/1974 | Yamamoto et al. |
| 3,855,045 | A | 12/1974 | Brock |
| 4,064,604 | A | 12/1977 | Hartman |
| 4,086,381 | A | 4/1978 | Cheshire et al. |
| 4,147,749 | A | 4/1979 | Lipscomb et al. |
| 4,163,819 | A | 8/1979 | Yung et al. |
| 4,189,338 | A | 2/1980 | Ejima et al. |
| 4,340,563 | A | 7/1982 | Appel et al. |
| 4,405,297 | A | 9/1983 | Appel et al. |
| 4,622,259 | A | 11/1986 | McAmish et al. |
| 4,692,371 | A | 9/1987 | Morman et al. |
| 4,988,560 | A | 1/1991 | Meyer et al. |

(Continued)

FOREIGN PATENT DOCUMENTS

| | | |
|---|---|---|
| DE | 40 14 414 | 11/1991 |

(Continued)

OTHER PUBLICATIONS

S. Chand et al., "Structure and properties of polypropylene fibers during thermal bonding," *Thermochimica Acta* 367-368 (2001) 155-160.

(Continued)

*Primary Examiner*—Lynda Salvatore
(74) *Attorney, Agent, or Firm*—Roger R. Tamte

(57) ABSTRACT

Nonwoven fibrous webs including amorphous polymeric fibers with improved and/or more convenient bondability are disclosed. The nonwoven fibrous webs may include only amorphous polymeric fibers or they may include additional components in addition to amorphous polymeric fibers. The amorphous polymeric fibers within the web may be autogeneously bonded or autogeneously bondable. The amorphous polymeric fibers may be characterized as varying in morphology over the length of continuous fibers so as to provide longitudinal segments that differ from one another in softening characteristics during a selected bonding operation.

44 Claims, 5 Drawing Sheets

U.S. PATENT DOCUMENTS 5,160,746 A 11/1992 Dodge, II et al.
5,173,356 A 12/1992 Eaton et al.
5,296,286 A 3/1994 Allen et al.
5,460,500 A 10/1995 Geus et al.
5,635,290 A 6/1997 Stopper et al.
5,652,051 A 7/1997 Shawver et al.
5,679,299 A * 10/1997 Gilbert et al. ..... 264/103
5,714,107 A * 2/1998 Levy et al. ..... 264/289.3
5,853,635 A 12/1998 Morell et al.
5,935,512 A 8/1999 Haynes et al.
5,958,322 A * 9/1999 Thompson et al. ... 264/342 RE
6,057,256 A 5/2000 Krueger et al.
6,165,217 A 12/2000 Hayes
6,183,684 B1 2/2001 Lu
6,274,238 B1 8/2001 DeLucia
6,379,136 B1 4/2002 Najour et al.
6,607,624 B2 * 8/2003 Berrigan et al. ..... 156/167
6,667,254 B1 * 12/2003 Thompson et al. ..... 442/351
2002/0102897 A1 8/2002 Berrigan et al.

FOREIGN PATENT DOCUMENTS

EP 0 538 480 4/1993
EP 1 138 813 A1 10/2001
WO WO 00/77285 A1 12/2000
WO WO 02 055782 7/2002

OTHER PUBLICATIONS

Letters to the Editors, Application of the Density-Gradient Tube in Fiber Research, *Journal of Polymer Science*, vol. 1, Nos. 1-6 (1946) 437-439.

* cited by examiner

NONWOVEN AMORPHOUS FIBROUS WEBS AND METHODS FOR MAKING THEM

FIELD OF THE INVENTION

This invention relates to bonded nonwoven webs that include amorphous polymeric fibers, and to methods for making such webs.

BACKGROUND OF THE INVENTION

The use of amorphous polymeric fibers in nonwoven fibrous webs often requires undesirable compromises in processing steps or product features. Known amorphous polymeric fibers are formed under conditions that result in uniform thermal properties (e.g., glass transition temperature) throughout the fibers. The uniform thermal properties of the fibers results in essentially simultaneous softening, thereby causing substantially the entire fiber to coalesce into a mass of polymer that loses its fibrous shape within a very small temperature range. Because the amorphous polymeric fibers lose their fibrous shape, during heat bonding, nonwoven fibrous webs that include known amorphous polymeric fibers must typically also include one or more components to assist with bonding or to provide a fibrous nature to the web.

For example, some nonwoven fibrous webs that include amorphous polymeric fibers as a predominant fiber in their construction may rely on the use of binders or other materials to bond the amorphous polymeric fibers within the web, thereby eliminating the need to heat the web to a temperature sufficient to soften and coalesce the amorphous polymeric fibers contained within the web. Disadvantages of this approach may include, however, the processing issues associated with applying and curing or drying the binder material. Another potential disadvantage is that the web includes materials other than the amorphous polymeric fibers, which may complicate recycling of the nonwoven webs due to the need to separate the different materials used in the finished web. Still another disadvantage is that the binder may leave the web more paperlike, stiff, brittle, etc. Furthermore, the binder may reduce the breathability of the web by at least partially occupying the interstices between the fibers of the web.

Some nonwoven fibrous webs include amorphous polymeric fibers mixed with other non-amorphous polymeric fibers, with the amorphous polymeric fibers being provided as a bonding agent. For example, the web may include non-amorphous polymeric fibers made of semicrystalline polymers, cotton, cellulose, etc., in addition to amorphous polymeric fibers. In these nonwoven fibrous webs, the amorphous polymeric fibers may be provided as a bonding agent, with the intent that the amorphous polymeric fibers, when heated, coalesce into masses of polymer that bind the other fibers together within the web. Nonwoven fibrous webs with such a construction may be point-bonded or wide area calendered. Wherever sufficient heat and pressure is applied to result in softening of the amorphous polymeric fibers within the web, the amorphous polymeric fibers will typically be substantially nonexistent because the amorphous polymeric fibers will have typically all coalesced to form the bonds between the other fibers within the web. For example, within the area occupied by a point bond, substantially all of the amorphous polymeric fibers will have coalesced to form the bond.

As with the use of separate binder materials, the use of amorphous polymeric fibers in combination with other fibers may increase the cost of the web, make the manufacturing operation more complex, and introduce extraneous ingredients into the webs. Further, the heat and pressure used to form the bonds can change the properties of the web, making it, e.g., more paperlike, stiff, or brittle.

SUMMARY OF THE INVENTION

The present invention provides nonwoven fibrous webs including amorphous polymeric fibers with improved and/or more convenient bondability. The nonwoven fibrous webs may consist essentially of amorphous polymeric fibers or they may include additional components in addition to amorphous polymeric fibers.

The amorphous polymeric fibers within the web may be autogeneously bonded or autogeneously bondable. The term "autogenous bonding" (and variations thereof) is defined as bonding between fibers at an elevated temperature as obtained in an oven or with a through-air bonder—also known as a hot-air knife—without application of solid contact pressure such as in point bonding or calendering, and preferably with no added binding fiber or other bonding material.

In contrast to known amorphous polymeric fibers, the amorphous polymeric fibers in the nonwoven fibrous webs of the invention may be characterized as varying in morphology over the length of continuous fibers so as to provide longitudinal segments that differ from one another in softening characteristics during a selected bonding operation. Some of these longitudinal segments soften under the conditions of a bonding operation, i.e., are active during the selected bonding operation such that they become bonded to other fibers of the web; and others of the segments do not soften, i.e., are passive during the bonding operation. In each of the continuous fibers, the active segments may be referred to as "active longitudinal segments" while the passive segments may be referred to as "passive longitudinal segments." Preferably, the active longitudinal segments soften sufficiently under useful bonding conditions, e.g., at a temperature low enough, that the web can be autogenously bonded directly to other fibers in the web.

Also in contrast to known amorphous polymeric fibers, the fibers of the present invention are capable of retaining their fibrous shape after being autogeneously bonded within a web.

It may also be preferred that continuous fibers of the amorphous polymeric fibers have a uniform diameter. By "uniform diameter" it is meant that the fibers have essentially the same diameter (varying by 10 percent or less) over a significant length (i.e., 5 centimeters or more) within which there can be and typically is variation in morphology of the amorphous polymer.

The fibers are preferably oriented; i.e., the fibers preferably comprise molecules that are locked into (i.e., are thermally trapped into) an alignment extending lengthwise of the fibers. The amorphous polymeric fibers in nonwoven fibrous webs of the present invention may, for example, be characterized as including portions of rigid or ordered amorphous polymer phases or oriented amorphous polymer phases (i.e., portions in which molecular chains within the fiber are aligned, to varying degrees, generally along the fiber axis).

The term "fiber" is used herein to mean a monocomponent fiber; a bicomponent or conjugate fiber (for convenience, the term "bicomponent" will often be used to mean fibers that consist of two components as well as fibers that consist of more than two components); and a fiber section of a bicomponent fiber, i.e., a section occupying part of the cross-section of and extending over the length of the bicomponent fiber. Monocomponent fibrous webs are often preferred, and the combination of orientation and bondability offered by the invention makes possible high-strength bondable webs using monocomponent fibers. Other webs of the invention comprise bicomponent fibers in which an amorphous polymeric fiber is one or more component (or fiber section) of a multicomponent fiber. In those multicomponent fibers in which the amorphous polymeric fiber occupies only part of the cross-section of the fiber, the amorphous polymeric fiber is preferably continuous along the length of the fiber, with active and passive segments as discussed herein. As a result, the multicomponent fiber can perform bonding functions as described herein, with the amorphous polymeric portions of the multi-component fiber retaining its original fibrous shape after autogeneous bonding.

Nonwoven fibrous webs of the invention can be prepared by fiber-forming processes in which filaments of fiber-forming material are extruded, subjected to orienting forces, and passed through a turbulent field of gaseous currents while at least some of the extruded filaments are in a softened condition and reach their freezing temperature (e.g., the temperature at which the fiber-forming material of the filaments solidifies) while in the turbulent field. A preferred method for making fibrous webs of the invention may include a) extruding filaments of fiber-forming material; b) directing the filaments through a processing chamber in which gaseous currents apply an orienting stress to the filaments; c) passing the filaments through a turbulent field after they exit the processing chamber; and d) collecting the processed filaments; the temperature of the filaments being controlled so that at least some of the filaments solidify after they exit the processing chamber but before they are collected. It may be preferred that the processing chamber be defined by two parallel walls, at least one of the walls being instantaneously movable toward and away from the other wall and being subject to movement means for providing instantaneous movement during passage of the filaments.

In addition to variations in morphology along the length of a continuous fiber, there can be variations in morphology between different amorphous polymeric fibers of a nonwoven fibrous web of the invention. For example, some fibers can be of larger diameter than others as a result of experiencing less orientation in the turbulent field. Larger-diameter fibers often have a less ordered morphology, and may participate (i.e., be active) in bonding operations to a different extent than smaller-diameter fibers, which often have a more highly developed morphology. The majority of bonds in a fibrous web of the invention may involve such larger-diameter fibers, which often, though not necessarily, themselves vary in morphology. But longitudinal segments of less ordered morphology (and therefore lower softening temperature) occurring within a smaller-diameter varied-morphology fiber preferably also participate in bonding of the web.

In one aspect, the present invention provides a nonwoven fibrous web including amorphous polymeric fibers that are autogeneously bonded within the web, wherein the autogeneously bonded amorphous polymeric fibers retain a fibrous shape after being autogeneously bonded.

In another aspect, the present invention provides a nonwoven fibrous web with amorphous polymeric fibers, wherein at least some continuous fibers of the amorphous polymeric fibers include one or more active longitudinal segments that bond to longitudinal segments of the same or others of the amorphous polymeric fibers, and further wherein the amorphous polymeric fibers have a fibrous shape within the web.

In another aspect, the present invention provides a nonwoven fibrous web with amorphous polymeric fibers, wherein at least some continuous fibers of the amorphous polymeric fibers exhibit at least one variation in morphology along their length such that the at least some continuous fibers include one or more active longitudinal segments that bond to longitudinal segments of the same or others of the amorphous polymeric fibers, and wherein the amorphous polymeric fibers have a fibrous shape within the web.

In another aspect, the present invention provides a method of making a nonwoven fibrous web by providing a plurality of amorphous polymeric fibers and autogeneously bonding the plurality of amorphous polymeric fibers within the web, wherein the autogeneously bonded amorphous polymeric fibers retain a fibrous shape after bonding.

These and other features and advantages of the invention may be described below in connection with some illustrative embodiments of the invention.

DESCRIPTION OF ILLUSTRATIVE EMBODIMENTS

Figure 1:
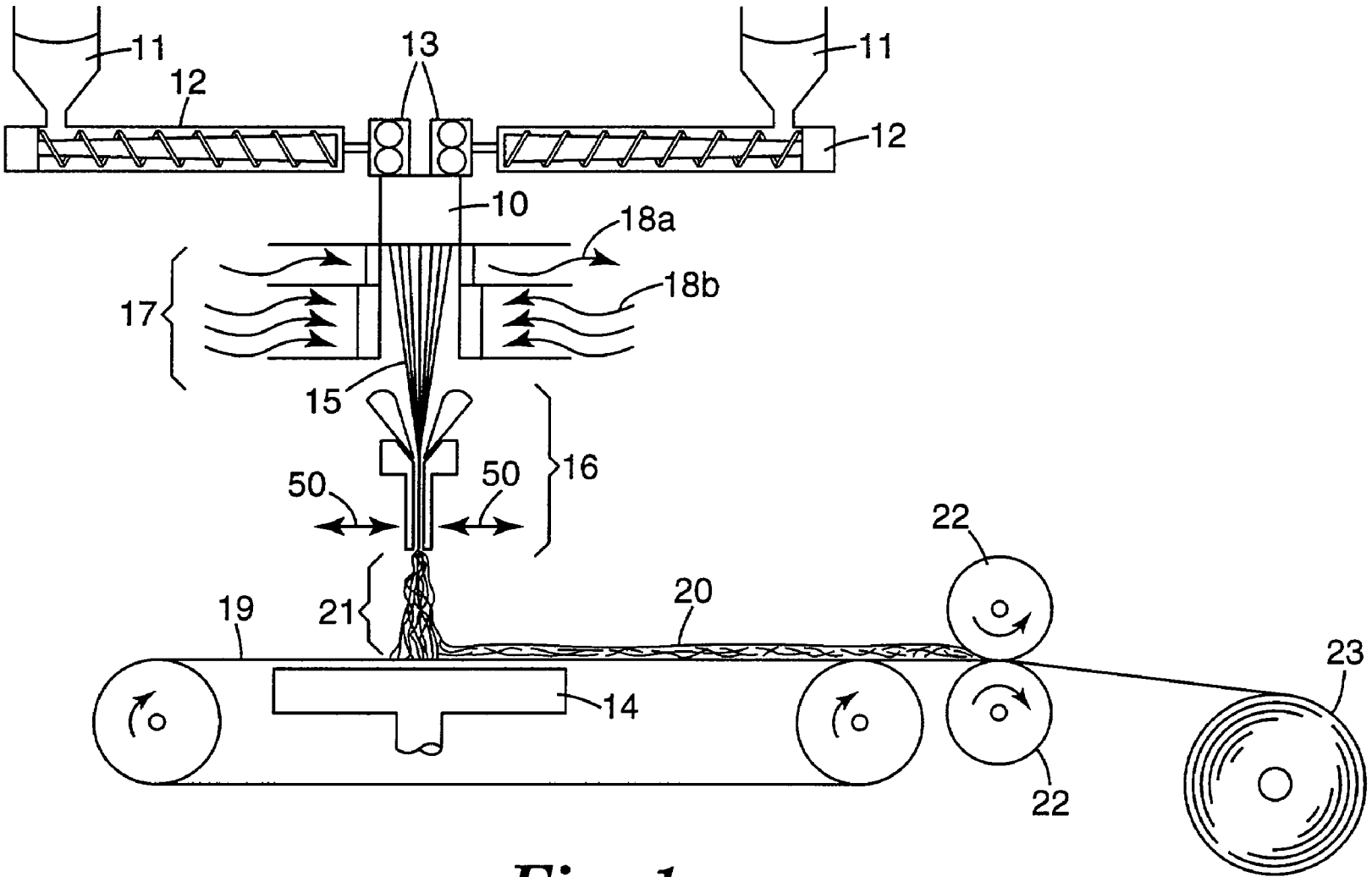
FIG. 1 is a schematic overall diagram of apparatus useful for forming a nonwoven fibrous web of the invention.

FIG. 1 shows an illustrative apparatus that can be used to prepare nonwoven fibrous webs of the invention. Fiber-forming material is brought to an extrusion head 10—in this particular illustrative apparatus, by introducing a fiber-forming material into hoppers 11, melting the material in an extruder 12, and pumping the molten material into the extrusion head 10 through a pump 13. Although solid polymeric material in pellet or other particulate form is most commonly used and melted to a liquid, pumpable state, other fiber-forming liquids such as polymer solutions could also be used.

The extrusion head 10 may be a conventional spinnerette or spin pack, generally including multiple orifices arranged in a regular pattern, e.g., straightline rows. Filaments 15 of fiber-forming liquid are extruded from the extrusion head and conveyed to a processing chamber or attenuator 16. As part of a desired control of the process, the distance 17 the extruded filaments 15 travel before reaching the attenuator 16 can be adjusted, as can the conditions to which they are exposed. Typically, some quenching streams of air or other gas 18 are presented to the extruded filaments by conventional methods and apparatus to reduce the temperature of the extruded filaments 15. Sometimes the quenching streams may be heated to obtain a desired temperature of the extruded filaments and/or to facilitate drawing of the filaments. There may be one or more streams of air (or other fluid)—e.g., a first stream 18*a* blown transversely to the filament stream, which may remove undesired gaseous materials or fumes released during extrusion; and a second quenching stream 18*b* that achieves a major desired temperature reduction. Depending on the process being used or the form of finished product desired, the quenching stream may be sufficient to solidify some of the extruded filaments 15 before they reach the attenuator 16. But in general, in a method of the invention extruded filamentary components are still in a softened or molten condition when they enter the attenuator. Alternatively, no quenching streams are used; in such a case ambient air or other fluid between the extrusion head 10 and the attenuator 16 may be a medium for any temperature change in the extruded filamentary components before they enter the attenuator.

The filaments 15 pass through the attenuator 16, as discussed in more detail below, and then exit. Most often, as pictured in FIG. 1, they exit onto a collector 19 where they are collected as a mass of fibers 20 that may or may not be coherent and take the form of a handleable web. The collector 19 is generally porous and a gas-withdrawal device 14 can be positioned below the collector to assist deposition of fibers onto the collector.

Between the attenuator 16 and collector 19 lies a field 21 of turbulent currents of air or other fluid. Turbulence occurs as the currents passing through the attenuator reach the unconfined space at the end of the attenuator, where the pressure that existed within the attenuator is released. The current stream widens as it exits the attenuator, and eddies develop within the widened stream. These eddies—whirlpools of currents running in different directions from the main stream—subject filaments within them to forces different from the straight-line forces the filaments are generally subjected to within and above the attenuator. For example, filaments can undergo a to-and-fro flapping within the eddies and be subjected to forces that have a vector component transverse to the length of the fiber.

The processed filaments are long and travel a tortuous and random path through the turbulent field. Different portions of the filaments experience different forces within the turbulent field. To some extent the lengthwise stresses on portions of at least some filaments are relaxed, and those portions consequently become less oriented than those portions that experience a longer application of the lengthwise stress.

At the same time, the filaments are cooling. The temperature of the filaments within the turbulent field can be controlled, for example, by controlling the temperature of the filaments as they enter the attenuator (e.g., by controlling the temperature of the extruded fiber-forming material, the distance between the extrusion head and the attenuator, and the amount and nature of the quenching streams), the length of the attenuator, the velocity and temperature of the filaments as they move through the attenuator, and the distance of the attenuator from the collector 19. By causing some or all of the filaments and segments thereof to cool within the turbulent field to the temperature at which the filaments or segments solidify, the differences in orientation experienced by different portions of the filaments, and the consequent morphology of the fibers, become frozen in, i.e., the molecules are thermally trapped in their aligned position. The different orientations that different fibers and different segments experienced as they passed through the turbulent field are retained to at least some extent in the fibers as collected on the collector 19.

Depending on the chemical composition of the filaments, different kinds of morphology can be obtained in a fiber. As discussed below, the possible morphological forms within a fiber include amorphous, rigid or ordered amorphous, and oriented amorphous. Different ones of these different kinds of morphology can exist along the length of a single continuous fiber, or can exist in different amounts or at different degrees of order or orientation. And these differences can exist to the extent that longitudinal segments along the length of the fiber differ in softening characteristics during a bonding operation.

After passing through a processing chamber and turbulent field as described, but prior to collection, extruded filaments or fibers may be subjected to a number of additional processing steps not illustrated in FIG. 1, e.g., further drawing, spraying, etc. Upon collection, the whole mass 20 of collected fibers may be conveyed to other apparatus such as a bonding oven, through-air bonder, calenders, embossing stations, laminators, cutters and the like; or it may be passed through drive rolls 22 and wound into a storage roll 23. Quite often, the mass is conveyed to an oven or through-air bonder, where the mass is heated to develop autogenous bonds that stabilize or further stabilize the mass as a handleable web. The invention may be particularly useful as a direct-web-formation process in which a fiber-forming polymeric material is converted into a web in one essentially direct operation (including extrusion of filaments, processing of the filaments, solidifying of the filaments in a turbulent field, collection of the processed filaments, and, if needed, further processing to transform the collected mass into a web). Nonwoven fibrous webs of the invention preferably include directly collected fibers or directly collected masses of fibers, meaning that the fibers are collected as a web-like mass as they leave the fiber-forming apparatus (other components such as staple fibers or particles can be collected together with the mass of directly formed fibers as described later herein).

Alternatively, fibers exiting the attenuator may take the form of filaments, tow or yarn, which may be wound onto a storage spool or further processed. Fibers of uniform diameter that vary in morphology along their length as described herein are understood to be novel and useful. That is, fibers having portions at least five centimeters long that have a 10-percent-or-less change in diameter but vary in morphology along that length, as indicated for example, by the presence of active and passive segments during a selected bonding operation, or by different degrees of order or orientation along the length, or by tests described later herein measuring gradations of density or of glass transition temperature range changes, are understood to be novel and useful. Such fibers or masses of fibers can be formed into webs, often after being chopped to carding lengths and optionally blended with other fibers, and combined into a nonwoven web form.

The apparatus pictured in FIG. 1 is of advantage in practicing the invention because it allows control over the temperature of filaments passing through the attenuator, allows filaments to pass through the chamber at fast rates, and can apply high stresses on the filaments that introduce desired high degrees of orientation on the filaments. (Apparatus as shown in the drawings has also been described in U.S. patent application Ser. No. 09/835,904, filed Apr. 16, 2001, and the corresponding PCT Application No. PCT/US01/46545 filed Nov. 8, 2001). Some potentially advantageous features of the apparatus are further shown in FIG. 2, which is an enlarged side view of a representative processing device or attenuator, and FIG. 3, which is a top view, partially schematic, of the processing apparatus shown in FIG. 2 together with mounting and other associated apparatus. The illustrative attenuator 16 comprises two movable halves or sides 16*a* and 16*b* separated so as to define between them the processing chamber 24: the facing surfaces of the sides 16*a* and 16*b* form the walls of the chamber. As seen from the top view in FIG. 3, the processing or attenuation chamber 24 is generally an elongated slot, having a transverse length 25 (transverse to the path of travel of filaments through the attenuator), which can vary depending on the number of filaments being processed.

Figure 2:
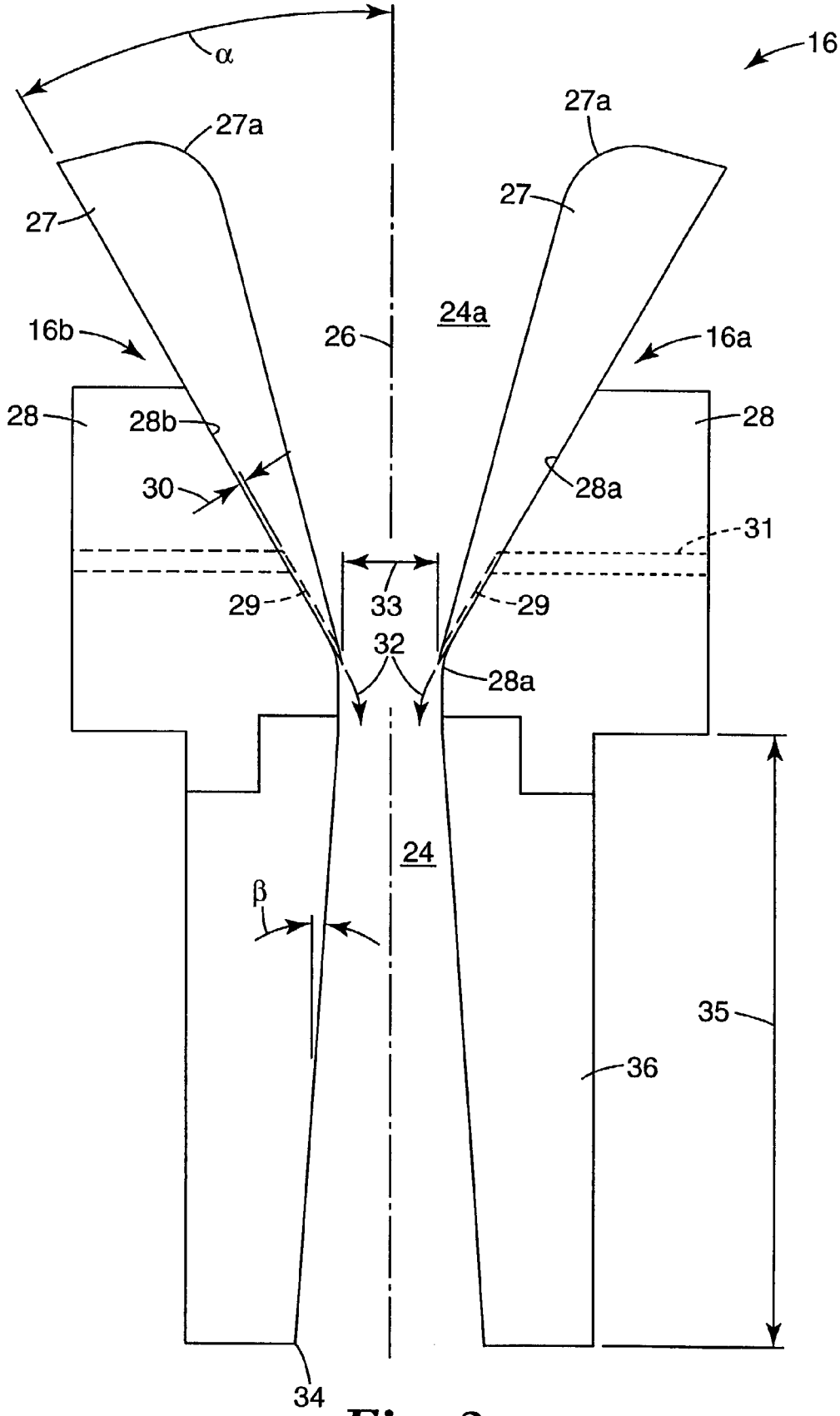
FIG. 2 is an enlarged side view of a processing chamber useful for forming a nonwoven fibrous web of the invention, with mounting means for the chamber not shown.
Figure 3:
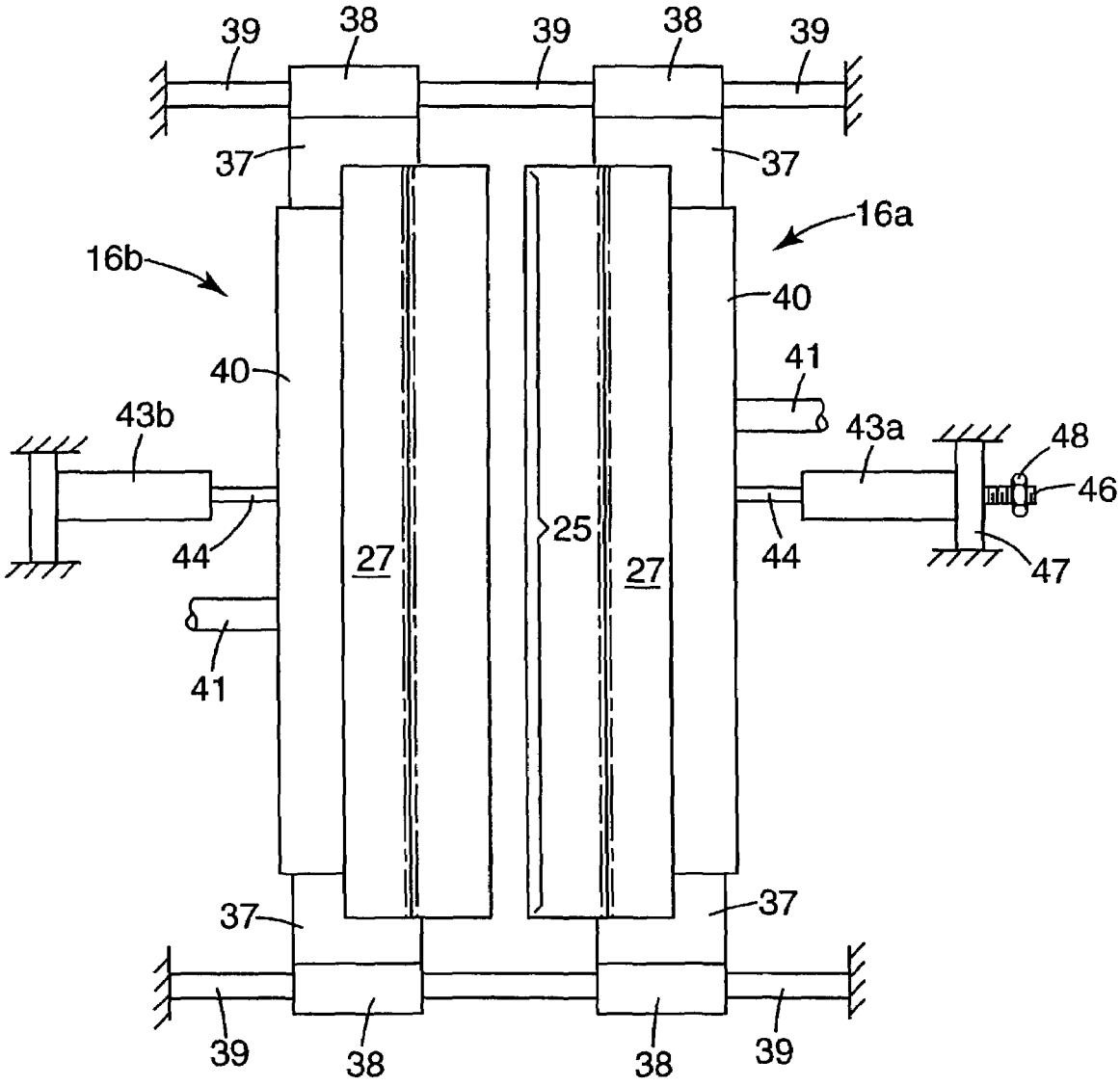
FIG. 3 is a top view, partially schematic, of the processing chamber shown in FIG. 2 together with mounting and other associated apparatus.

Although existing as two halves or sides, the attenuator functions as one unitary device and will be first discussed in its combined form. (The structure shown in FIGS. 2 and 3 is representative only, and a variety of different constructions may be used.) The representative attenuator 16 includes slanted entry walls 27, which define an entrance space or throat 24*a* of the attenuation chamber 24. The entry walls 27 preferably are curved at the entry edge or surface 27*a* to smooth the entry of air streams carrying the extruded filaments 15. The walls 27 are attached to a main body portion 28, and may be provided with a recessed area 29 to establish a gap 30 between the body portion 28 and wall 27. Air may be introduced into the gaps 30 through conduits 31, creating air knives (represented by the arrows 32) that increase the velocity of the filaments traveling through the attenuator, and that also have a further quenching effect on the filaments. The attenuator body 28 is preferably curved at 28*a* to smooth the passage of air from the air knife 32 into the passage 24. The angle ($\alpha$) of the surface 28*b* of the attenuator body can be selected to determine the desired angle at which the air knife impacts a stream of filaments passing through the attenuator. Instead of being near the entry to the chamber, the air knives may be disposed further within the chamber.

The attenuation chamber 24 may have a uniform gap width (the horizontal distance 33 on the page of FIG. 2 between the two attenuator sides is herein called the gap width) over its longitudinal length through the attenuator (the dimension along a longitudinal axis 26 through the attenuation chamber is called the axial length). Alternatively, as illustrated in FIG. 2, the gap width may vary along the length of the attenuator chamber. The attenuation chamber may be narrower internally within the attenuator; e.g., as shown in FIG. 2, the gap width 33 at the location of the air knives is the narrowest width, and the attenuation chamber expands in width along its length toward the exit opening 34, e.g., at an angle $\beta$. Such a narrowing internally within the attenuation chamber 24, followed by a broadening, creates a venturi effect that increases the mass of air inducted into the chamber and adds to the velocity of filaments traveling through the chamber. In a different embodiment, the attenuation chamber is defined by straight or flat walls; in such embodiments the spacing between the walls may be constant over their length, or alternatively the walls may slightly diverge or converge over the axial length of the attenuation chamber. In all these cases, the walls defining the attenuation chamber are regarded as parallel herein, because the deviation from exact parallelism is relatively slight. As illustrated in FIG. 2, the walls defining the main portion of the longitudinal length of the passage 24 may take the form of plates 36 that are separate from, and attached to, the main body portion 28.

The length of the attenuation chamber 24 can be varied to achieve different effects; variation is especially useful with the portion between the air knives 32 and the exit opening 34, sometimes called herein the chute length 35. The angle between the chamber walls and the axis 26 may be wider near the exit 34 to change the distribution of fibers onto the collector as well as to change the turbulence and patterns of the current field at the exit of the attenuator. Structure such as deflector surfaces, Coanda curved surfaces, and uneven wall lengths also may be used at the exit to achieve a desired current force-field as well as spreading or other distribution of fibers. In general, the gap width, chute length, attenuation chamber shape, etc. are chosen in conjunction with the material being processed and the mode of treatment desired to achieve desired effects. For example, longer chute lengths may be useful to increase the crystallinity of prepared fibers. Conditions are chosen and can be widely varied to process the extruded filaments into a desired fiber form.

As illustrated in FIG. 3, the two sides 16*a* and 16*b* of the representative attenuator 16 are each supported through mounting blocks 37 attached to linear bearings 38 that slide on rods 39. The bearing 38 has a low-friction travel on the rod through means such as axially extending rows of ball-bearings disposed radially around the rod, whereby the sides 16*a* and 16*b* can readily move toward and away from one another. The mounting blocks 37 are attached to the attenuator body 28 and a housing 40 through which air from a supply pipe 41 is distributed to the conduits 31 and air knives 32.

In this illustrative embodiment, air cylinders 43*a* and 43*b* are connected, respectively, to the attenuator sides 16*a* and 16*b* through connecting rods 44 and apply a clamping force pressing the attenuator sides 16*a* and 16*b* toward one another. The clamping force is chosen in conjunction with the other operating parameters so as to balance the pressure existing within the attenuation chamber 24. In other words, under preferred operating conditions the clamping force is in balance or equilibrium with the force acting internally within the attenuation chamber to press the attenuator sides apart, e.g., the force created by the gaseous pressure within the attenuator. Filamentary material can be extruded, passed through the attenuator and collected as finished fibers while the attenuator parts remain in their established equilibrium or steady-state position and the attenuation chamber or passage 24 remains at its established equilibrium or steady-state gap width.

During operation of the representative apparatus illustrated in FIGS. 1-3, movement of the attenuator sides or chamber walls generally occurs only when there is a perturbation of the system. Such a perturbation may occur when a filament being processed breaks or tangles with another filament or fiber. Such breaks or tangles are often accompanied by an increase in pressure within the attenuation chamber 24, e.g., because the forward end of the filament coming from the extrusion head or the tangle is enlarged and creates a localized blockage of the chamber 24. The increased pressure can be sufficient to force the attenuator sides or chamber walls 16*a* and 16*b* to move away from one another. Upon this movement of the chamber walls the end of the incoming filament or the tangle can pass through the attenuator, whereupon the pressure in the attenuation chamber 24 returns to its steady-state value before the perturbation, and the clamping pressure exerted by the air cylinders 43 returns the attenuator sides to their steady-state position. Other perturbations causing an increase in pressure in the attenuation chamber include "drips," i.e., globular liquid pieces of fiber-forming material falling from the exit of the extrusion head upon interruption of an extruded filament, or accumulations of extruded filamentary material that may engage and stick to the walls of the attenuation chamber or to previously deposited fiber-forming material.

In effect, one or both of the attenuator sides 16*a* and 16*b* "float," i.e., are not held in place by any structure but instead are mounted for a free and easy movement laterally in the direction of the arrows 50 in FIG. 1. In a preferred arrangement, the only forces acting on the attenuator sides other than friction and gravity are the biasing force applied by the air cylinders and the internal pressure developed within the attenuation chamber 24. Other clamping means than the air cylinder may be used, such as a spring(s), deformation of an elastic material, or cams; but the air cylinder offers a desired control and variability.

Many alternatives are available to cause or allow a desired movement of the processing chamber wall(s). For example, instead of relying on fluid pressure to force the wall(s) of the processing chamber apart, a sensor within the chamber (e.g., a laser or thermal sensor detecting buildup on the walls or plugging of the chamber) may be used to activate a servomechanical mechanism that separates the wall(s) and then returns them to their steady-state position. In another useful apparatus of the invention, one or both of the attenuator sides or chamber walls is driven in an oscillating pattern, e.g., by a servomechanical, vibratory or ultrasonic driving device. The rate of oscillation can vary within wide ranges, including, for example, at least rates of 5,000 cycles per minute to 60,000 cycles per second.

In still another variation, the movement means for both separating the walls and returning them to their steady-state position takes the form simply of a difference between the fluid pressure within the processing chamber and the ambient pressure acting on the exterior of the chamber walls. More specifically, during steady-state operation, the pressure within the processing chamber (a summation of the various forces acting within the processing chamber established, for example, by the internal shape of the processing chamber, the presence, location and design of air knives, the velocity of a fluid stream entering the chamber, etc.) is in balance with the ambient pressure acting on the outside of the chamber walls. If the pressure within the chamber increases because of a perturbation of the fiber-forming process, one or both of the chamber walls moves away from the other wall until the perturbation ends, whereupon pressure within the processing chamber is reduced to a level less than the steady-state pressure (because the gap width between the chamber walls is greater than at the steady-state operation). Thereupon, the ambient pressure acting on the outside of the chamber walls forces the chamber wall(s) back until the pressure within the chamber is in balance with the ambient pressure, and steady-state operation occurs. Lack of control over the apparatus and processing parameters can make sole reliance on pressure differences a less desired option.

In sum, besides being instantaneously movable and in some cases "floating," the wall(s) of the processing chamber are also generally subject to means for causing them to move in a desired way. The walls can be thought of as generally connected, e.g., physically or operationally, to means for causing a desired movement of the walls. The movement means may be any feature of the processing chamber or associated apparatus, or an operating condition, or a combination thereof that causes the intended movement of the movable chamber walls—movement apart, e.g., to prevent or alleviate a perturbation in the fiber-forming process, and movement together, e.g., to establish or return the chamber to steady-state operation.

In the embodiment illustrated in FIGS. 1-3, the gap width 33 of the attenuation chamber 24 is interrelated with the pressure existing within the chamber, or with the fluid flow rate through the chamber and the fluid temperature. The clamping force matches the pressure within the attenuation chamber and varies depending on the gap width of the attenuation chamber: for a given fluid flow rate, the narrower the gap width, the higher the pressure within the attenuation chamber, and the higher must be the clamping force. Lower clamping forces allow a wider gap width. Mechanical stops, e.g., abutting structure on one or both of the attenuator sides 16*a* and 16*b* may be used to assure that minimum or maximum gap widths are maintained.

In one useful arrangement, the air cylinder 43*a* applies a larger clamping force than the cylinder 43*b*, e.g., by use in cylinder 43*a* of a piston of larger diameter than used in cylinder 43*b*. This difference in force establishes the attenuator side 16*b* as the side that tends to move most readily when a perturbation occurs during operation. The difference in force is about equal to and compensates for the frictional forces resisting movement of the bearings 38 on the rods 39. Limiting means can be attached to the larger air cylinder 43*a* to limit movement of the attenuator side 16*a* toward the attenuator side 16*b*. One illustrative limiting means, as shown in FIG. 3, uses as the air cylinder 43*a* a double-rod air cylinder, in which the second rod 46 is threaded, extends through a mounting plate 47, and carries a nut 48 which may be adjusted to adjust the position of the air cylinder. Adjustment of the limiting means, e.g., by turning the nut 48, positions the attenuation chamber 24 into alignment with the extrusion head 10.

Because of the described instantaneous separation and reclosing of the attenuator sides 16*a* and 16*b*, the operating parameters for a fiber-forming operation are expanded. Some conditions that would previously make the process inoperable—e.g., because they would lead to filament breakage requiring shutdown for rethreading—become acceptable; upon filament breakage, rethreading of the incoming filament end generally occurs automatically. For example, higher velocities that lead to frequent filament breakage may be used. Similarly, narrow gap widths, which cause the air knives to be more focused and to impart more force and greater velocity on filaments passing through the attenuator, may be used. Or filaments may be introduced into the attenuation chamber in a more molten condition, thereby allowing greater control over fiber properties, because the danger of plugging the attenuation chamber is reduced. The attenuator may be moved closer to or further from the extrusion head to control among other things the temperature of the filaments when they enter the attenuation chamber.

Although the chamber walls of the attenuator 16 are shown as generally monolithic structures, they can also take the form of an assemblage of individual parts each mounted for the described instantaneous or floating movement. The individual parts comprising one wall engage one another through sealing means so as to maintain the internal pressure within the processing chamber 24. In a different arrangement, flexible sheets of a material such as rubber or plastic form the walls of the processing chamber 24, whereby the chamber can deform locally upon a localized increase in pressure (e.g., because of a plugging caused by breaking of a single filament or group of filaments). A series or grid of biasing means may engage the segmented or flexible wall;

sufficient biasing means are used to respond to localized deformations and to bias a deformed portion of the wall back to its undeformed position. Alternatively, a series or grid of oscillating means may engage the flexible wall and oscillate local areas of the wall. Or, in the manner discussed above, a difference between the fluid pressure within the processing chamber and the ambient pressure acting on the wall or localized portion of the wall may be used to cause opening of a portion of the wall(s), e.g., during a process perturbation, and to return the wall(s) to the undeformed or steady-state position, e.g., when the perturbation ends. Fluid pressure may also be controlled to cause a continuing state of oscillation of a flexible or segmented wall.

As will be seen, in the embodiment of processing chamber illustrated in FIGS. 2 and 3, there are no side walls at the ends of the transverse length of the chamber. The result is that fibers passing through the chamber can spread outwardly outside the chamber as they approach the exit of the chamber. Such a spreading can be desirable to widen the mass of fibers collected on the collector. In other embodiments, the processing chamber does include side walls, though a single side wall at one transverse end of the chamber is not attached to both chamber sides 16*a* and 16*b*, because attachment to both chamber sides would prevent separation of the sides as discussed above. Instead, a sidewall(s) may be attached to one chamber side and move with that side when and if it moves in response to changes of pressure within the passage. In other embodiments, the side walls are divided, with one portion attached to one chamber side, and the other portion attached to the other chamber side, with the sidewall portions preferably overlapping if it is desired to confine the stream of processed fibers within the processing chamber.

While apparatus as shown, in which the walls are instantaneously movable, are much preferred, the invention can also be run—generally with less convenience and efficiency—with apparatus using processing chambers as taught in the prior art in which the walls defining the processing chamber are fixed in position.

A wide variety of amorphous polymeric fiber-forming materials may be used to make fibrous webs of the invention. Suitable materials for forming the filaments include amorphous polymers such as polycarbonates, polyacrylics, polymethacrylics, polybutadiene, polyisoprene, polychloroprene, random and block copolymers of styrene and dienes (e.g., styrene-butadiene rubber (SBR)), butyl rubber, ethylene-propylene-diene monomer rubber, natural rubber, ethylene-propylene rubber, and mixtures thereof. Other examples of suitable polymers include, e.g., polystyrene-polyethylene copolymers, polyvinylcyclohexane, polyacrylonitrile, polyvinylchloride, thermoplastic polyurethanes, aromatic epoxies, amorphous polyesters, amorphous polyamides, acrylonitrile-butadienestyrene (ABS) copolymers, polyphenylene oxide alloys, high impact polystyrene copolymers, polydimethyl siloxanes, polyetherimides, methacrylic acid-polyethylene copolymers, impact-modified polyolefins, amorphous fluoropolymers, amorphous polyolefins, polyphenylene oxide, polyphenylene oxide—polystyrene alloys, and mixtures thereof. Other potentially suitable polymers include, e.g., styreneisoprene block copolymers, styrene-ethylene/butylene-styrene block copolymers (SEBS), styrene-ethylene-propylene-styrene block copolymers, styrene-isoprene-styrene block copolymers (SIS), styrene-butadiene-styrene (SBS) block copolymers, ethylene-propylene copolymers, styrene-ethylene copolymers, polyetheresters, and poly-u,-olefin based materials such as those represented by the formula —(CH2CHR)x where R is an alkyl group containing 2 to 10 carbon atoms and poly-a-olefin based on metallocene catalysts, and mixtures thereof.

Some polymers or materials that are more difficult to form into fibers by spunbond or meltblown techniques can be used, including, e.g., cyclic olefins (which have a high melt viscosity that limits their utility in conventional direct-extrusion techniques), block copolymers, styrene-based polymers, polycarbonates, acrylics, polyacrylonitriles, and adhesives (including pressure-sensitive varieties and hot-melt varieties). (With respect to block copolymers, it may be noted that the individual blocks of the copolymers may vary in morphology, as when one block is crystalline or semicrystalline and the other block is amorphous; the variation in morphology exhibited by fibers of the invention is not such a variation, but instead is a more macro property in which several molecules participate in forming a generally physically identifiable portion of a fiber.) The specific polymers listed here are examples only, and a wide variety of other polymeric or fiber-forming materials are useful. A further discussion of nonwoven fibrous webs made using other polymers that may include amorphous polymers is contained in U.S. application Ser. No. 10/151,782, filed on even date herewith and titled BONDABLE, ORIENTED, NONWOVEN FIBROUS WEBS AND METHODS FOR MAKING THEM. Interestingly, fiber-forming processes of the invention using molten polymers can often be performed at lower temperatures than traditional direct extrusion techniques, which offers a number of advantages.

Fibers also may be formed from blends of materials, including materials into which certain additives have been blended, such as pigments or dyes. As noted above, bicomponent fibers, such as core-sheath or side-by-side bicomponent fibers, may be prepared ("bicomponent" herein includes fibers with more than two components). In addition, different fiber-forming materials may be extruded through different orifices of the extrusion head so as to prepare webs that comprise a mixture of fibers. In other embodiments of the invention other materials are introduced into a stream of fibers prepared according to the invention before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared according to the present invention may be introduced into a stream of other fibers to prepare a blend of fibers.

Besides the variation in orientation between fibers and segments discussed above, webs and fibers of the invention can exhibit other unique characteristics. For example, in some collected webs, fibers are found that are interrupted, i.e., are broken, or entangled with themselves or other fibers, or otherwise deformed as by engaging a wall of the processing chamber. The fiber segments at the location of the interruption—i.e., the fiber segments at the point of a fiber break, and the fiber segments in which an entanglement or deformation occurs—are all termed an interrupting fiber segment herein, or more commonly for shorthand purposes, are often simply termed "fiber ends": these interrupting fiber segments form the terminus or end of an unaffected length of fiber, even though in the case of entanglements or deformations there often is no actual break or severing of the fiber.

The fiber ends have a fiber form (as opposed to a globular shape as sometimes obtained in meltblowing or other previous methods) but are usually enlarged in diameter over the medial or intermediate portions of the fiber; usually they are less than 300 micrometers in diameter. Often, the fiber ends, especially broken ends, have a curly or spiral shape, which causes the ends to entangle with themselves or other fibers. And the fiber ends may be bonded side-by-side with other fibers, e.g., by autogenous coalescing of material of the fiber end with material of an adjacent fiber.

Fiber ends as described arise because of the unique character of the fiber-forming process illustrated in FIGS. 1-3, which (as will be discussed in further detail below) can continue in spite of breaks and interruptions in individual fiber formation. Such fiber ends may not occur in all collected webs of the invention, but can occur at least at some useful operating process parameters. Individual fibers may be subject to an interruption, e.g., may break while being drawn in the processing chamber, or may entangle with themselves or another fiber as a result of being deflected from the wall of the processing chamber or as a result of turbulence within the processing chamber; but notwithstanding such interruption, the fiber-forming process of the invention continues. The result is that the collected web can include a significant and detectable number of the fiber ends, or interrupting fiber segments where there is a discontinuity in the fiber. Since the interruption typically occurs in or after the processing chamber, where the fibers are typically subjected to drawing forces, the fibers are under tension when they break, entangle or deform. The break, or entanglement generally results in an interruption or release of tension allowing the fiber ends to retract and gain in diameter. Also, broken ends are free to move within the fluid currents in the processing chamber, which at least in some cases leads to winding of the ends into a spiral shape and entangling with other fibers. Webs including fibers with enlarged fibrous ends can have the advantage that the fiber ends may comprise a more easily softened material adapted to increase bonding of a web; and the spiral shape can increase coherency of the web. Though in fibrous form, the fiber ends have a larger diameter than intermediate or middle portions. The interrupting fiber segments, or fiber ends, generally occur in a minor amount. The intermediate main portion of the fibers ("middles" comprising "medial segments") have the characteristics noted above. The interruptions are isolated and random, i.e., they do not occur in a regular repetitive or predetermined manner.

The medially located longitudinal segments discussed above (often referred to herein simply as longitudinal segments or medial segments) differ from the just-discussed fiber ends, among other ways, in that the longitudinal segments generally have the same or similar diameter as adjacent longitudinal segments. Although the forces acting on adjacent longitudinal segments can be sufficiently different from one another to cause the noted differences in morphology between the segments, the forces are not so different as to substantially change the diameter or draw ratio of the adjacent longitudinal segments within the fibers. Preferably, adjacent longitudinal segments differ in diameter by no more than about 10 percent. More generally, significant lengths—such as, e.g., five centimeters or more—of fibers in webs of the invention do not vary in diameter by more than 10 percent. Such uniformity in diameter is advantageous, for example, because it contributes to a uniformity of properties within the web, and may also allow for a lofty and low-density web. Such uniformity of properties and loftiness may be further enhanced when webs of the invention are bonded without substantial deformation of fibers as can occur in point-bonding or calendering of a web. Over the full length of the fiber, the diameter may (but preferably does not) vary substantially more than 10 percent; but the change is gradual so that adjacent longitudinal segments are of the same or similar diameter. The longitudinal segments may vary widely in length, from very short lengths as long as a fiber diameter (e.g., about 10 micrometers) to longer lengths such as 30 centimeters or more. Often the longitudinal segments are less than about two millimeters in length.

While adjacent longitudinal segments may not differ greatly in diameter in webs of the invention, there may be significant variation in diameter from fiber to fiber. As a whole, a particular fiber may experience significant differences from another fiber in the aggregate of forces acting on the fiber, and those differences can cause the diameter and draw ratio of the particular fiber to be different from those of other fibers. Larger-diameter fibers tend to have a lesser draw ratio and a less-developed morphology than smaller-diameter fibers. Larger-diameter fibers can be more active in bonding operations than smaller-diameter fibers, especially in autogenous bonding operations. Within a web, the predominant bonding may be obtained from larger-diameter fibers. However, we have also observed webs in which bonding seems more likely to occur between small-diameter fibers. The range of fiber diameters within a web usually can be controlled by controlling the various parameters of the fiber-forming operation. Narrow ranges of diameters are often preferred, for example, to make properties of the web more uniform and to minimize the heat that is applied to the web to achieve bonding.

Although differences in morphology exist within a web sufficiently for improved bonding, the fibers also can be sufficiently developed in morphology to provide desired strength properties, durability, and dimensional stability. The fibers themselves can be strong, and the improved bonds achieved because of the more active bonding segments and fibers further improves web strength. The combination of good web strength with increased convenience and performance of bonds achieves good utility for webs of the invention. The amorphous polymeric fibers may include portions with molecular orientation sufficient to reach the rigid or ordered amorphous phase or the oriented amorphous phase, thereby increasing strength and stability of the web. Combination of such fibers in a web with autogenous bonds may provide further advantages for the nonwoven fibrous webs of the invention. The fibers of the web can be rather uniform in diameter over most of their length and independent from other fibers to obtain webs having desired loft properties. Lofts of 90 percent (the inverse of solidity and including the ratio of the volume of the air in a web to the total volume of the web multiplied by 100) or more can be obtained and are useful for many purposes such as filtration or insulation. Even the less-oriented fiber segments preferably have undergone some orientation that enhances fiber strength along the full length of the fiber.

In sum, fibrous webs of the invention generally include continuous fibers that have longitudinal segments differing from one another in morphology and consequent bonding characteristics, and that also can include fiber ends that exhibit morphologies and bonding characteristics differing from those of at least some other segments in the fibers; and the fibrous webs can also include fibers that differ from one another in diameter and have differences in morphology and bonding characteristics from other fibers within the web.

The final morphology of the fibers can be influenced both by the turbulent field and by selection of other operating parameters, such as degree of solidification of filament entering the attenuator, velocity and temperature of air stream introduced into the attenuator by the air knives, and axial length, gap width and shape (because, for example, shape influences the venturi effect) of the attenuator passage.

It is typically possible to form the nonwoven fibrous webs of the present invention solely through the use of autogenous bonds, e.g., obtained by heating a web of the invention without application of calendering pressure. Such bonds may allow softer hand to the web and greater retention of loft under pressure. However, pressure bonds as in point-bonding or area-wide calendering may also be used in connection with the webs of the present invention. Bonds can also be formed by application of infrared, laser, ultrasonic or other energy forms that thermally or otherwise activate bonding between fibers. Solvent application may also be used. Webs can exhibit both autogenous bonds and pressure-formed bonds, as when the web is subjected only to limited pressure that is instrumental in only some of the bonds. Webs having autogenous bonds are regarded as autogenously bonded herein, even if other kinds of pressure-formed bonds are also present in limited amounts. In general, in practicing the invention a bonding operation is desirably selected that allows some longitudinal segments to soften and be active in bonding to an adjacent fiber or portion of a fiber, while other longitudinal segments remain passive or inactive in achieving bonds.

Figure 4:
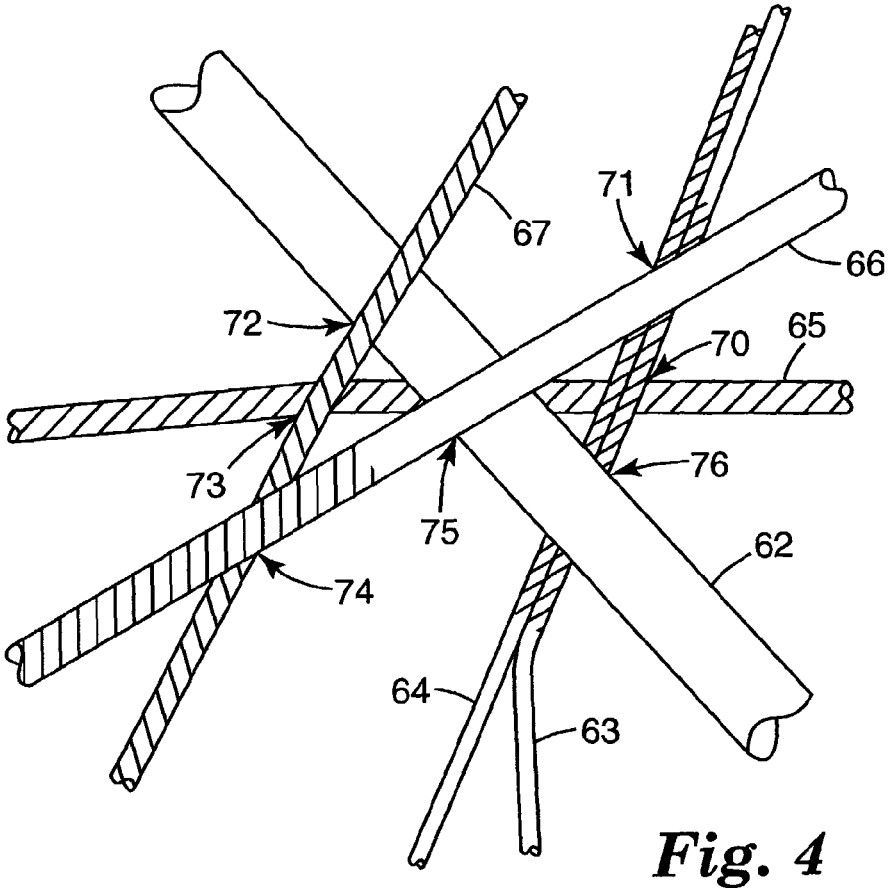
FIG. 4 depicts bonding between passive and active segments of amorphous polymeric fibers of the present invention.

FIG. 4 illustrates the active/passive segment feature of the fibers used in nonwoven fibrous webs of the present invention. The collection of fibers illustrated in FIG. 4 include longitudinal segments that, within the boundaries of FIG. 4, are active along their entire length, longitudinal segments that are passive along their entire length, and fibers that include both active and passive longitudinal segments. The portions of the fibers depicted with cross-hatching are active and the portions without cross-hatching are passive. Although the boundaries between active and passive longitudinal segments are depicted as sharp for illustrative purposes, it should be understood that the boundaries may be more gradual in actual fibers.

More specifically, fiber 62 is depicted as being completely passive within the boundaries of FIG. 4. Fibers 63 and 64 are depicted with both active and passive segments within the boundaries of FIG. 4. Fiber 65 is depicted as being completely active within the boundaries of FIG. 4. Fiber 66 is depicted with both active and passive segments within the boundaries of FIG. 4. Fiber 67 is depicted as being active along its entire length as seen within FIG. 4.

The intersection 70 between fibers 63, 64 and 65 will typically result in a bond because all of the fiber segments at that intersection are active ("intersection" herein means a place where fibers contact one another; three-dimensional viewing of a sample web will typically be needed to examine whether there is contacting and/or bonding). The intersection 71 between fibers 63, 64 and 66 will also typically result in a bond because fibers 63 and 64 are active at that intersection (even though fiber 66 is passive at the intersection). Intersection 71 illustrates the principle that, where an active segment and a passive segment contact each other, a bond will typically be formed at that intersection. That principle is also seen at intersection 72 where fibers 62 and 67 cross, with a bond being formed between the active segment of fiber 67 and the passive segment of fiber 62. Intersections 73 and 74 illustrate bonds between the active segments of fibers 65 and 67 (intersection 73) and the active segments of fibers 66 and 67 (intersection 74). At intersection 75, a bond will typically be formed between the passive segment of fiber 62 and the active segment of fiber 65. A bond will not, however, typically be formed between the passive segment of fiber 62 and the passive segment of fiber 66 that also cross at intersection 75. As a result, intersection 75 illustrates the principle that two passive segments in contact with each other will not typically result in a bond. Intersection 76 will typically include bonds between the passive segment of fiber 62 and the active segments of fibers 63 and 64 that meet at that intersection.

Fibers 63 and 64 illustrate that where two fibers 63 and 64 lie next to each other along portions of their lengths, the fibers 63 and 64 will typically bond provided that one or both of the fibers are active (such bonding may occur during preparation of the fibers). As a result, fibers 63 and 64 are depicted as bonded to each other between intersections 71 and 76 because both fibers are active over that distance. In addition, at the upper end of FIG. 4, fibers 63 and 64 are also bonded where only fiber 64 is active. In contrast, at the lower end of FIG. 4, fibers 63 and 64 diverge where both fibers transition to passive segments.

Analytical comparisons may be performed on different segments (internal segments as well as fiber ends) of fibers of the invention to show the different characteristics and properties. A variation in density often accompanies the variation in morphology of fibers of the invention, and the variation in density can typically be detected by a Test for Density Gradation Along Fiber Length (sometimes referred to more shortly as the Graded Density test), defined herein. This test is based on a density-gradient technique described in ASTM D1505-85. The technique uses a density-gradient tube, i.e., a graduated cylinder or tube filled with a solution of at least two different-density liquids that mix to provide a gradation of densities over the height of the tube. In a standard test, the liquid mixture fills the tube to at least a 60-centimeter height so as to provide a desired gradual change in the density of the liquid mixture. The density of the liquid should change over the height of the column at a rate between about 0.0030 and 0.0015 gram/cubic centimeter/centimeter of column height. Pieces of fiber from the sample of fibers or web being tested are cut in lengths of 1 millimeter and dropped into the tube. Webs are sampled in at least three places at least three inches (7.62 centimeters) apart. The fibers are extended without tension on a glass plate and cut with a razor knife. A glass plate 40 mm long, 22 mm wide, and 0.15 mm thick is used to scrape the cut fiber pieces from the glass plate on which they were cut. The fibers are deionized with a beta radiation source for 30 seconds before they are placed in the column.

The fibers are allowed to settle in place for 48 hours before measurements of density and fiber position are made. The pieces settle in the column to their density level, and they assume a position varying from horizontal to vertical depending on whether they vary in density over their length: constant-density pieces assume a horizontal position, while pieces that vary in density deviate from horizontal and assume a more vertical position. In a standard test, twenty pieces of fiber from a sample being tested are introduced into the density-gradient tube. Some fiber pieces may become engaged against the tube wall, and other fiber pieces may become bunched with other fiber pieces. Such engaged or bunched fibers are disregarded, and only the free pieces—not engaged and not bunched—are considered. The test must be re-run if less than half the twenty pieces introduced into the column remain as free pieces.

Angular measurements are obtained visually to the nearest 5-degree increment. The angular disposition of curved fibers-is based on the tangent at the midpoint of the curved fiber. In the standard test of fibers or webs of the invention, at least five of the free pieces generally will assume a position at least thirty degrees from horizontal in the test. More preferably, at least half of the free pieces assume such a position. Also, more preferably the pieces (at least five and preferably at least half the free pieces) assume a position 45 degrees or more from horizontal, or even 60 or 85 degrees or more from horizontal. The greater the angle from horizontal, the greater the differences in density, which tends to correlate with greater differences in morphology, thereby making a bonding operation that distinguishes active from passive segments more likely and more convenient to perform. Also, the higher the number of fiber pieces that are disposed at an angle from horizontal, the more prevalent the variation in morphology tends to be, which further assists in obtaining desired bonding.

Different fiber segments may also exhibit differences in morphology that can be detected based on differences in properties as measured by Modulated Differential Scanning Calorimetry (MDSC). For example, data was obtained using unprocessed amorphous polymers (i.e., pellets of the polymers used to form the fibers of the present invention), amorphous polymeric fibers manufactured according to the present invention, and the amorphous polymeric fibers of the invention after simulated bonding (heating to simulate, e.g., an autogeneous bonding operation).

A difference in the thermal properties between the amorphous polymeric fibers as formed and the amorphous polymeric fibers after simulated bonding can suggest that processing to form the fibers significantly affects the amorphous polymeric material in a manner that improves its bonding performance. All MDSC scans of the fibers as formed and the fibers after simulated bonding presented significant thermal stress release which may be proof of significant levels of orientation in both the fibers as formed and the fibers after simulated bonding. That stress release may, for example, be evidenced by shifts up or down in the glass transition range when comparing the amorphous polymeric fibers as formed with the amorphous polymeric fibers after simulated bonding. Although not wishing to be bound by theory, it may be described that portions of the amorphous polymeric fibers of the present invention exhibit ordered local packing of the molecular structures, sometimes referred to as a rigid or ordered amorphous fraction as a result of the combination thermal treatment and orientation of the filaments during fiber formation (see, e.g., P. P. Chiu et al., *Macromolecules,* 33, 9360-9366).

The thermal behavior of the amorphous polymer used to manufacture the fibers was significantly different than the thermal behavior of the amorphous polymeric fibers before or after simulated bonding. That thermal behavior may preferably include, e.g., changes in the glass transition range. As such, it may be advantageous to characterize the amorphous polymeric fibers of the present invention as having a broadened glass transition range in which, as compared to the polymer before processing, both the onset temperature (i.e., the temperature at which the onset of softening occurs) and the end temperature (i.e., the temperature at which substantially all of the polymer reaches the rubbery phase), of the glass transition range for the amorphous polymeric fibers move in a manner that increases the overall glass transition range. In other words, the onset temperature decreases and the end temperature increases. In some instances, it may be sufficient that only the end temperature of the glass transition range increases.

The broadened glass transition range may provide a wider process window in which autogeneous bonding may be performed while the amorphous polymeric fibers retain their fibrous shape (because all of the polymer in the fibers does not soften within the narrower glass transition range of known fibers). It should be noted that the broadened glass transition range is preferably measured against the glass transition range of the starting polymer after it has been heated and cooled to remove residual stresses that may be present as a result of, e.g., processing of the polymer into pellets for distribution.

Again, not wishing to be bound by theory, it may be considered that orientation of the amorphous polymer in the fibers may result in a lowering of the onset temperature of the glass transition range. At the other end of the glass transition range, those portions of the amorphous polymeric fibers that reach the rigid or ordered amorphous phase as a result of processing as described above may provide the raised end temperature of the glass transition range. As a result, changes in drawing or orientation of the fibers during manufacturing may be useful to modify the broadening of the glass transition range, e.g., improve the broadening or reduce the broadening.

Upon bonding of a web of the invention by heating it in an oven, the morphology of the fiber segments may be modified. The heating of the oven has an annealing effect. Thus, while oriented amorphous fibers may have a tendency to shrink upon heating (which can be minimized by the presence of rigid or ordered amorphous phase for the amorphous polymer of the fibers), the annealing effect of the bonding operation, together with the stabilizing effect of the bonds themselves, can reduce shrinkage.

The average diameter of fibers prepared according to the invention may range widely. Microfiber sizes (about 10 micrometers or less in diameter) may be obtained and offer several benefits; but fibers of larger diameter can also be prepared and are useful for certain applications; often the fibers are 20 micrometers or less in diameter. Fibers of circular cross-section are most often prepared, but other cross-sectional shapes may also be used. Depending on the operating parameters chosen, e.g., degree of solidification from the molten state before entering the attenuator, the collected fibers may be rather continuous or essentially discontinuous.

Various processes conventionally used as adjuncts to fiber-forming processes may be used in connection with filaments as they enter or exit from the attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

Although there typically is no reason to do so, filaments may be blown from the extrusion head by a primary gaseous stream in the manner of that used in conventional meltblowing operations. Such primary gaseous streams cause an initial attenuation and drawing of the filaments.

EXAMPLES

The following examples are provided to enhance understanding of the present invention. They are not intended to limit the scope of the invention.

Example 1

Apparatus as shown in FIGS. 1-3 was used to prepare amorphous polymeric fibers using cyclic-olefin polymer (TOPAS 6017 from Ticona). The polymer was heated to 320° C. in the extruder (temperature measured in the extruder 12 near the exit to the pump 13), and the die was heated to a temperature of 320° C. The extrusion head or die had four rows, and each row had 42 orifices, making a total of 168 orifices. The die had a transverse length of 4 inches (102 millimeters (mm)). The orifice diameter was 0.020 inch (0.51 mm) and the L/D ratio was 6.25. The polymer flow rate was 1.0 g/orifice/minute.

The distance between the die and attenuator (dimension 17 in FIG. 1) was 33 inches (about 84 centimeters), and the distance from the attenuator to the collector (dimension 21 in FIG. 1) was 24 inches (about 61 centimeters). The air knife gap (the dimension 30 in FIG. 2) was 0.030 inch (0.762 millimeter); the attenuator body angle (α in FIG. 2) was 30°; room temperature air was passed through the attenuator; and the length of the attenuator chute (dimension 35 in FIG. 2) was 6.6 inches (168 millimeters). The air knife had a transverse length (the direction of the length 25 of the slot in FIG. 3) of about 120 millimeters; and the attenuator body 28 in which the recess for the air knife was formed had a transverse length of about 152 millimeters. The transverse length of the wall 36 attached to the attenuator body was 5 inches (127 millimeters).

The attenuator gap at the top was 1.6 mm (dimension 33 in FIG. 2). The attenuator gap at the bottom was 1.7 mm (dimension 34 in FIG. 2). The total volume of air passed through the attenuator was 3.62 Actual Cubic Meters per Minute (ACMM); with about half of the volume passing through each air knife 32.

Figure 5:
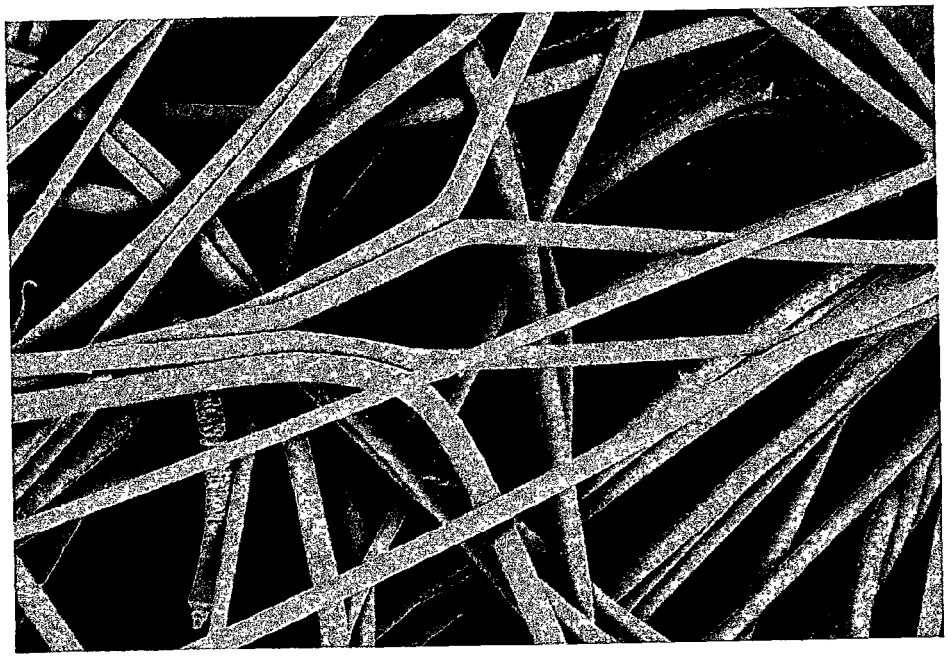
FIG. 5 is a scanning electron micrograph of an illustrative web from Example 1 of the invention described below.

Fibrous webs were collected on a conventional porous web-forming collector in an unbonded condition. The webs were then heated in an oven at 300° C. for 1 minute. The latter step caused autogenous bonding within the webs as illustrated in FIG. 5 (a micrograph taken at a magnification of 200× using a Scanning Electron Microscope). As can be seen, the autogeneously bonded amorphous polymeric fibers retain their fibrous shape after bonding.

To illustrate the variation in morphology exhibited along the length of the fibers, a gravimetric analysis was performed using the Graded Density test described above. The column contained a mixture of water and calcium nitrate solution according to ASTM D1505-85. Results for twenty pieces moving from top to bottom within the column are given in Table 1.

TABLE 1

| Angle in Column (degrees from Horizontal) |
|---|
| 80 |
| 90 |
| 85 |
| 85 |
| 90 |
| 80 |
| 85 |
| 80 |
| 90 |
| 85 |
| 85 |
| 90 |
| 80 |
| 90 |
| 85 |
| 85 |
| 85 |
| 90 |
| 90 |
| 80 |

The average angle of the fibers was 85.5 degrees, the median was 85 degrees.

Example 2

Apparatus as shown in FIGS. 1-3 was used to prepare amorphous polymeric fibers using polystyrene (Crystal PS 3510 from Nova Chemicals) having Melt Flow Index of 15.5 and density of 1.04. The polymer was heated to 268° C. in the extruder (temperature measured in the extruder 12 near the exit to the pump 13), and the die was heated to a temperature of 268° C. The extrusion head or die had four rows, and each row had 42 orifices, making a total of 168 orifices. The die had a transverse length of 4 inches (102 millimeters). The orifice diameter was 0.343 mm and the LID ratio was 9.26. The polymer flow rate was 1.00 g/orifice/minute.

The distance between the die and attenuator (dimension 17 in FIG. 1) was about 318 millimeters, and the distance from the attenuator to the collector (dimension 21 in FIG. 1) was 610 millimeters. The air knife gap (the dimension 30 in FIG. 2) was 0.76 millimeter; the attenuator body angle (α in FIG. 2) was 30°; air with a temperature of 25 degrees Celsius was passed through the attenuator; and the length of the attenuator chute (dimension 35 in FIG. 2) was (152 millimeters). The air knife had a transverse length (the direction of the length 25 of the slot in FIG. 3) of about 120 millimeters; and the attenuator body 28 in which the recess for the air knife was formed had a transverse length of 152 millimeters. The transverse length of the wall 36 attached to the attenuator body was 5 inches (127 millimeters).

The attenuator gap at the top was 4.4 mm (dimension 33 in FIG. 2). The attenuator gap at the bottom was 3.1 mm (dimension 34 in FIG. 2). The total volume of air passed through the attenuator was 2.19 ACMM (Actual Cubic Meters per Minute); with about half of the volume passing through each air knife 32.

Fibrous webs were collected on a conventional porous web-forming collector in an unbonded condition. The webs were then heated in an oven at 200° C. for 1 minute. The latter step caused autogenous bonding within the webs, with the autogeneously bonded amorphous polymeric fibers retaining their fibrous shape after bonding.

To illustrate the variation in morphology exhibited along the length of the fibers, a gravimetric analysis was performed using the Graded Density test described above. The column contained a mixture of water and calcium nitrate solution according to ASTM D1505-85. Results for twenty pieces moving from top to bottom within the column are given in Table 2.

TABLE 2

| Angle in Column (degrees from Horizontal) |
|---|
| 85 |
| 75 |
| 90 |
| 70 |
| 75 |
| 90 |
| 80 |
| 90 |
| 75 |
| 85 |
| 80 |
| 90 |
| 90 |
| 75 |
| 90 |
| 85 |
| 75 |

TABLE 2-continued

| Angle in Column (degrees from Horizontal) |
|---|
| 80 |
| 90 |
| 90 |

The average angle of the fibers was 83 degrees, the median was 85 degrees.

Example 3

Apparatus as shown in FIGS. 1-3 was used to prepare amorphous polymeric fibers using a block copolymer with 13 percent styrene and 87 percent ethylene butylene copolymer (KRATON G1657 from Shell) with a Melt Flow Index of 8 and density of 0.9. The polymer was heated to 275° C. in the extruder (temperature measured in the extruder 12 near the exit to the pump 13), and the die was heated to a temperature of 275° C. The extrusion head or die had four rows, and each row had 42 orifices, making a total of 168 orifices. The die had a transverse length of 4 inches (101.6 millimeters). The orifice diameter was 0.508 mm and the LID ratio was 6.25. The polymer flow rate was 0.64 g/orifice/minute.

The distance between the die and attenuator (dimension 17 in FIG. 1) was 667 millimeters, and the distance from the attenuator to the collector (dimension 21 in FIG. 1) was 330 millimeters. The air knife gap (the dimension 30 in FIG. 2) was 0.76 millimeter; the attenuator body angle ($\alpha$ in FIG. 2) was 30°; air with a temperature of 25 degrees Celsius was passed through the attenuator; and the length of the attenuator chute (dimension 35 in FIG. 2) was 76 millimeters. The air knife had a transverse length (the direction of the length 25 of the slot in FIG. 3) of about 120 millimeters; and the attenuator body 28 in which the recess for the air knife was formed had a transverse length of about 152 millimeters. The transverse length of the wall 36 attached to the attenuator body was 5 inches (127 millimeters).

The attenuator gap at the top was 7.6 mm (dimension 33 in FIG. 2). The attenuator gap at the bottom was 7.2 mm (dimension 34 in FIG. 2). The total volume of air passed through the attenuator was 0.41 ACMM (Actual Cubic Meters per Minute); with about half of the volume passing through each air knife 32.

Fibrous webs were collected on a conventional porous web-forming collector, with the fibers autogenously bonding as the fibers were collected. The autogeneously bonded amorphous polymeric fibers retained their fibrous shape after bonding.

To illustrate the variation in morphology exhibited along the length of the fibers, a gravimetric analysis was performed using the Graded Density test described above. The column contained a mixture of methanol and water according to ASTM D1505-85. Results for twenty pieces moving from top to bottom within the column are given in Table 3.

TABLE 3

| Angle in Column (degrees from Horizontal) |
|---|
| 55 |
| 45 |
| 50 |

TABLE 3-continued

| Angle in Column (degrees from Horizontal) |
|---|
| 30 |
| 45 |
| 45 |
| 50 |
| 35 |
| 40 |
| 55 |
| 55 |
| 40 |
| 45 |
| 55 |
| 40 |
| 35 |
| 35 |
| 40 |
| 50 |
| 55 |

The average angle of the fibers was 45 degrees, the median was 45 degrees.

Example 4

Apparatus as shown in FIGS. 1-3 was used to prepare amorphous polymeric fibers using polycarbonate (General Electric SLCC HF 1110P resin). The polymer was heated to 300° C. in the extruder (temperature measured in the extruder 12 near the exit to the pump 13), and the die was heated to a temperature of 300° C. The extrusion head or die had four rows, and each row had 21 orifices, making a total of 84 orifices. The die had a transverse length of 4 inches (102 millimeters). The orifice diameter was 0.035 inch (0.889 mm) and the L/D ratio was 3.5. The polymer flow rate was 2.7 g/orifice/minute.

The distance between the die and attenuator (dimension 17 in FIG. 1) was 15 inches (about 38 centimeters), and the distance from the attenuator to the collector (dimension 21 in FIG. 1) was 28 inches (71.1 centimeters). The air knife gap (the dimension 30 in FIG. 2) was 0.030 inch (0.76 millimeter); the attenuator body angle ($\alpha$ in FIG. 2) was 30°; room temperature air was passed through the attenuator; and the length of the attenuator chute (dimension 35 in FIG. 2) was 6.6 inches (168 millimeters). The air knife had a transverse length (the direction of the length 25 of the slot in FIG. 3) of about 120 millimeters; and the attenuator body 28 in which the recess for the air knife was formed had a transverse length of about 152 millimeters. The transverse length of the wall 36 attached to the attenuator body was 5 inches (127 millimeters).

The attenuator gap at the top was 0.07 (1.8 mm) (dimension 33 in FIG. 2). The attenuator gap at the bottom was 0.07 inch (1.8 mm) (dimension 34 in FIG. 2). The total volume of air passed through the attenuator (given in actual cubic meters per minute, or ACMM) was 3.11; with about half of the volume passing through each air knife 32.

Fibrous webs were collected on a conventional porous web-forming collector in an unbonded condition. The webs were then heated in an oven at 200° C. for 1 minute. The latter step caused autogenous bonding within the webs, with the autogeneously bonded amorphous polymeric fibers retaining their fibrous shape after bonding.

To illustrate the variation in morphology exhibited along the length of the fibers, a gravimetric analysis was performed using the Graded Density test described above. The column contained a mixture of water and calcium nitrate solution according to ASTM D1505-85. Results for twenty pieces moving from top to bottom within the column are given in Table 4.

TABLE 4

| Angle in Column (degrees from Horizontal) |
|---|
| 90 |
| 90 |
| 90 |
| 85 |
| 90 |
| 90 |
| 90 |
| 90 |
| 85 |
| 90 |
| 90 |
| 85 |
| 90 |
| 90 |
| 90 |
| 90 |
| 90 |
| 85 |
| 90 |
| 90 |

The average angle of the fibers was 89 degrees, the median was 90 degrees.

Example 5

Apparatus as shown in FIGS. 1-3 was used to prepare amorphous polymeric fibers using polystyrene (BASF Polystyrene 145D resin). The polymer was heated to 245° C. in the extruder (temperature measured in the extruder 12 near the exit to the pump 13), and the die was heated to a temperature of 245° C. The extrusion head or die had four rows, and each row had 21 orifices, making a total of 84 orifices. The die had a transverse length of 4 inches (101.6 millimeters). The orifice diameter was 0.035 inch (0.889 mm) and the L/D ratio was 3.5. The polymer flow rate was 0.5 g/orifice/minute.

The distance between the die and attenuator (dimension 17 in FIG. 1) was 15 inches (about 38 centimeters), and the distance from the attenuator to the collector (dimension 21 in FIG. 1) was 25 inches (63.5 centimeters). The air knife gap (the dimension 30 in FIG. 2) was 0.030 inch (0.762 millimeter); the attenuator body angle ($\alpha$ in FIG. 2) was 30°; room temperature air was passed through the attenuator; and the length of the attenuator chute (dimension 35 in FIG. 2) was 6.6 inches (167.64 millimeters). The air knife had a transverse length (the direction of the length 25 of the slot in FIG. 3) of about 120 millimeters; and the attenuator body 28 in which the recess for the air knife was formed had a transverse length of about 152 millimeters. The transverse length of the wall 36 attached to the attenuator body was 5 inches (127 millimeters).

The attenuator gap at the top was 0.147 inch (3.73 mm) (dimension 33 in FIG. 2). The attenuator gap at the bottom was 0.161 inch (4.10 mm) (dimension 34 in FIG. 2). The total volume of air passed through the attenuator (given in actual cubic meters per minute, or ACMM) was 3.11; with about half of the volume passing through each air knife 32.

Fibrous webs were collected on a conventional porous web-forming collector in an unbonded condition. The webs were then heated in a through-air bonder at 100° C. for 1 minute. The latter step caused autogenous bonding within the webs, with the autogeneously bonded amorphous polymeric fibers retaining their fibrous shape after bonding.

Testing using a TA Instruments Q1000 Differential Scanning Calorimeter was conducted to determine the effect of processing on the glass transition range of the polymer. A linear heating rate of 5° C. per minute was applied to each sample, with a perturbation amplitude of ±1° C. every 60 seconds. The samples were subjected to a heat-cool-heat profile ranging from 0° C. to about 150° C.

Figure 6:
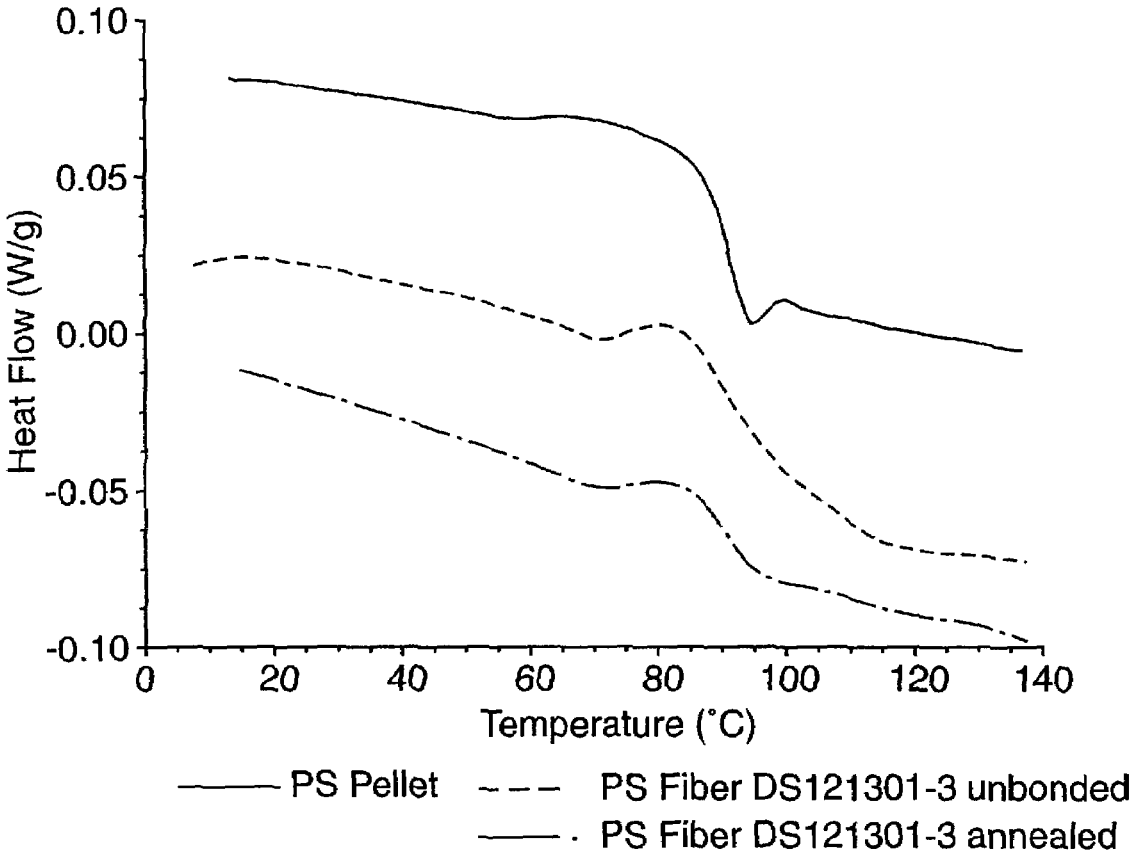
FIG. 6 is a graph of thermal properties of polymers and polymer fibers using Modulated Differential Scanning Calorimetry as described in Example 5.

The results of testing on the bulk polymer, i.e., polymer that is not formed into fibers and the polymers formed into fibers (before and after simulated bonding) are depicted in FIG. 6. It can be seen that, within the glass transition range, the onset temperature of the fibers before simulated bonding is lower than the onset temperature of the bulk polymer. Also, the end temperature of the glass transition range for the fibers before simulated bonding is higher than the end temperature of the bulk polymer. As a result, the glass transition range of the amorphous polymeric fibers is larger than the glass transition range of the bulk polymer.

The preceding specific embodiments are illustrative of the practice of the invention. This invention may be suitably practiced in the absence of any element or item not specifically described in this document. The complete disclosures of all patents, patent applications, and publications are incorporated into this document by reference as if individually incorporated. Various modifications and alterations of this invention will become apparent to those skilled in the art without departing from the scope of this invention. It should be understood that this invention is not to be unduly limited to illustrative embodiments set forth herein.

The invention claimed is:

1. A nonwoven fibrous web comprising oriented amorphous polymeric fibers that are drawn in attenuating apparatus and have amorphous polymer molecular chains aligned lengthwise of the fibers, are of uniform diameter along their length, and at least some of which comprise longitudinal segments that differ in level of molecular orientation such as to exhibit different softening characteristics during a bonding operation, some segments softening so as to be active during the bonding operation to form autogenous bonds to longitudinal segments of the same or others of the fibers while remaining amorphous and while retaining a fibrous shape within the web, and other segments remaining passive during the bonding operation, the fibers being autogenously bonded and in fibrous shape within the web.

2. A web according to claim 1, wherein, in a Graded Density test, at least five fiber pieces of the amorphous polymeric fibers become disposed at an angle of at least 30 degrees from horizontal.

3. A web according to claim 1, wherein, in a Graded Density test described herein, at least five fiber pieces of the amorphous polymeric fibers become disposed at an angle of at least 60 degrees from horizontal.

4. A web according to claim 1, wherein, in a Graded Density test described herein, at least half of the fiber pieces of the amorphous polymeric fibers become disposed at an angle of at least 30 degrees from horizontal.

5. A web according to claim 1, wherein, in a Graded Density test described herein, at least half of the fiber pieces of the amorphous polymeric fibers become disposed at an angle of at least 60 degrees from horizontal.

6. A web according to claim 1, wherein, in a Graded Density test described herein, fiber pieces from the amorphous polymeric fibers become disposed at an average angle of at least 30 degrees from horizontal.

7. A web according to claim 1, wherein one level of the different levels of molecular orientation comprises an ordered amorphous phase.

8. A web according to claim 1, wherein one level of the different levels of molecular orientation comprises an oriented amorphous phase.

9. A web according to claim 1, wherein the amorphous polymeric fibers consist essentially of a uniform chemical composition.

10. A web according to claim 1, wherein web exhibits 15% or less shrinkage when autogeneously bonded.

11. A web according to claim 1, wherein the web consists essentially of the amorphous polymeric fibers.

12. A web according to claim 1, wherein the web comprises one or more components in addition to the autogeneously bonded amorphous polymeric fibers.

13. A web according to claim 12, wherein the one or more components are selected from the group consisting of fibers, particulates, and dispersions.

14. A web according to claim 1 in which the amorphous polymeric fibers comprise a cyclic-olephin polymer.

15. A web according to claim 1 in which the amorphous polymeric fibers comprise polystyrene.

16. A web according to claim 1 in which the amorphous polymeric fibers comprise polycarbonate.

17. A nonwoven fibrous web comprising amorphous polymeric fibers in which amorphous polymer molecular chains are aligned lengthwise of the fibers and the fibers are of uniform diameter along their length, wherein at least some of the fibers comprise longitudinal segments that differ in level of molecular orientation such as to exhibit different softening characteristics during a bonding operation, some segments softening sufficiently to be active during the bonding operation and other segments being passive during the bonding operation, the active segments being capable of autogenously bonding to longitudinal segments of the same or others of the fibers while the fibers remain amorphous and retain a fibrous shape within the web.

18. A web according to claim 17, wherein the amorphous polymeric fibers are autogeneously bonded by the active longitudinal segments.

19. A web according to claim 17, wherein, in a Graded Density test described herein, at least five fiber pieces of the amorphous polymeric fibers become disposed at an angle of at least 30 degrees from horizontal.

20. A web according to claim 17, wherein, in a Graded Density test described at least five fiber pieces of the amorphous polymeric fibers become disposed at an angle of at least 60 degrees from horizontal.

21. A web according to claim 17, wherein, in a Graded Density test described herein, at least half of the fiber pieces of the amorphous polymeric fibers become disposed at an angle of at least 30 degrees from horizontal.

22. A web according to claim 17, wherein, in a Graded Density test described herein, at least half of the fiber pieces of the amorphous polymeric fibers become disposed at an angle of at least 60 degrees from horizontal.

23. A web according to claim 17, wherein, in a Graded Density test described herein, fiber pieces from the amorphous polymeric fibers become disposed at an average angle of at least 30 degrees from horizontal.

24. A web according to claim 17, wherein one level of the different levels of molecular orientation comprises an ordered amorphous phase.

25. A web according to claim 17, wherein one level of the different levels of molecular orientation comprises an oriented amorphous phase.

26. A web according to claim 17, wherein the amorphous polymeric fibers consist essentially of a uniform chemical composition.

27. A web according to claim 17, wherein the web exhibits 15% or less shrinkage when autogeneously bonded by the active longitudinal segments of the amorphous polymeric fibers.

28. A web according to claim 17, wherein the web consists essentially of the amorphous polymeric fibers comprising the active longitudinal segments.

29. A web according to claim 17, wherein the web comprises one or more components in addition to the amorphous polymeric fibers.

30. A web according to claim 29, wherein the one or more components are selected from the group consisting of fibers, particulates, and dispersions.

31. A nonwoven fibrous web comprising amorphous polymeric fibers in which amorphous polymer molecular chains are aligned lengthwise of the fibers and the fibers are of uniform diameter along their length, wherein at least some of the fibers exhibit at least one variation in morphology along their length such as to comprise one or more active longitudinal segments that bond to longitudinal segments of the same or others of the fibers while remaining amorphous and while retaining a fibrous shape within the web; the at least one variation in morphology comprising different levels of molecular orientation sufficiently different for the active longitudinal segments to be autogenously bondable to other fibers and for other segments to be passive during the bonding operation.

32. A web according to claim 31, wherein the amorphous polymeric fibers are autogeneously bonded by the active longitudinal segments.

33. A web according to claim 31, wherein, in a Graded Density test described herein, at least five fiber pieces of the amorphous polymeric fibers become disposed at an angle of at least 30 degrees from horizontal.

34. A web according to claim 31, wherein, in a Graded Density test described herein, at least five fiber pieces of the amorphous polymeric fibers become disposed at an angle of at least 60 degrees from horizontal.

35. A web according to claim 31, wherein, in a Graded Density test described herein, at least half of the fiber pieces of the amorphous polymeric fibers become disposed at an angle of at least 30 degrees from horizontal.

36. A web according to claim 31, wherein, in a Graded Density test described herein, at least half of the fiber pieces of the amorphous polymeric fibers become disposed at an angle of at least 60 degrees from horizontal.

37. A web according to claim 31, wherein, in a Graded Density test described herein, fiber pieces from the amorphous polymeric fibers become disposed at an average angle of at least 30 degrees from horizontal.

38. A web according to claim 31, wherein one level of the different levels of molecular orientation comprises an ordered amorphous phase.

39. A web according to claim 31, wherein one level of the different levels of molecular orientation comprises an oriented amorphous phase.

40. A web according to claim 31, wherein the amorphous polymeric fibers consist essentially of a uniform chemical composition.

41. A web according to claim 31, wherein the web exhibits 15% or less shrinkage when autogeneously bonded by the active longitudinal segments of the amorphous polymeric fibers.

42. A web according to claim 31, wherein the web consists essentially of the amorphous polymeric fibers comprising the active longitudinal segments.

43. A web according to claim 31, wherein the web comprises one or more components in addition to the amorphous polymeric fibers.

44. A web according to claim 1, wherein the one or more components are selected from the group consisting of fibers, particulates, and dispersions.

* * * * *

UNITED STATES PATENT AND TRADEMARK OFFICE

CERTIFICATE OF CORRECTION

PATENT NO. : 7,279,440 B2
APPLICATION NO. : 10/151780
DATED : October 9, 2007
INVENTOR(S) : Michael R. Berrigan et al.

It is certified that error appears in the above-identified patent and that said Letters Patent is hereby corrected as shown below:

Column 1,
Line 22, delete “shape,” and insert in place thereof --shape--.

Column 16,
Line 65, delete “fibers-is” and insert in place thereof --fibers is--.

Column 20,
Line 13, delete “LID” and insert in place thereof --L/D--.

Column 21,
Line 26, delete “LID” and insert in place thereof --L/D--.

Column 25,
Line 47, after “described” insert --herein,--.

Column 28,
Line 1, delete “claim1” and insert in place thereof --claim 43--.

Signed and Sealed this

Twenty-fifth Day of March, 2008

JON W. DUDAS
*Director of the United States Patent and Trademark Office*